US008721278B2

(12) United States Patent
Shteyman et al.

(10) Patent No.: US 8,721,278 B2
(45) Date of Patent: May 13, 2014

(54) EXHAUST MANIFOLD FLANGE CONNECTION

(75) Inventors: Yevgeniy Shteyman, West Palm Beach, FL (US); James Marshall, Lugoff, SC (US); Brian Micklos, Oviedo, FL (US); Jonathan Leagon, Cassatt, SC (US); Christopher Scogin, Columbia, SC (US); Brian H. Terpos, Oviedo, FL (US); Robert T. Brooks, Chuluota, FL (US); Scott Smith, West Palm Beach, FL (US); Robert W. Spitzer, Sanford, FL (US); David Wiebe, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 607 days.

(21) Appl. No.: 13/045,626

(22) Filed: Mar. 11, 2011

(65) Prior Publication Data

US 2012/0023968 A1 Feb. 2, 2012

Related U.S. Application Data

(60) Provisional application No. 61/369,895, filed on Aug. 2, 2010.

(51) Int. Cl.
*F01D 25/24* (2006.01)

(52) U.S. Cl.
USPC ..... 415/214.1

(58) Field of Classification Search
USPC ..... 415/215.1, 219.1, 222
See application file for complete search history.

(56) References Cited

U.S. PATENT DOCUMENTS

| | | | | |
|---|---|---|---|---|
| 2,799,472 | A | 7/1957 | Rainbow | |
| 3,532,274 | A | 10/1970 | Wilkinson | |
| 4,072,327 | A | 2/1978 | Young | |
| 4,907,743 | A | 3/1990 | Bouiller et al. | |
| 6,065,756 | A | 5/2000 | Eignor et al. | |
| 6,662,568 | B2 | 12/2003 | Shimizu et al. | |
| 6,807,803 | B2 * | 10/2004 | Poccia et al. | 60/39.5 |
| 6,931,861 | B2 | 8/2005 | Wagner | |
| 7,584,621 | B2 | 9/2009 | Spitzer et al. | |

* cited by examiner

*Primary Examiner* — Nathaniel Wiehe
*Assistant Examiner* — Michael Sehn

(57) ABSTRACT

A flange connection for an exhaust section of a gas turbine engine. The flange connection includes a stub flange attached to an exhaust manifold. The stub flange has a first axial face for engagement with the axial face of a cylinder flange extending radially from an exhaust cylinder. A plate structure attached to the cylinder flange is configured to provide axial retention of the stub flange to the axial face of the cylinder flange. The plate structure includes a resilient beam portion extending radially inwardly and engaging a second axial face of the stub flange. The stub flange is retained between the cylinder flange and the beam portion of the plate structure in an interference fit to provide three degrees of freedom of the stub flange relative to the exhaust cylinder.

17 Claims, 4 Drawing Sheets

EXHAUST MANIFOLD FLANGE CONNECTION

CROSS-REFERENCE TO RELATED APPLICATIONS

This application claims the benefit of U.S. Provisional Application No. 61/369,895, filed Aug. 2, 2010, which is incorporated herein by reference.

FIELD OF THE INVENTION

The present invention relates to gas turbine engines and, more particularly, to connection structures for accommodating thermal expansion between adjacent sections of a gas turbine engine.

BACKGROUND OF THE INVENTION

A gas turbine engine generally includes a compressor section, a combustor section, a turbine section and an exhaust section. In operation, the compressor section may induct ambient air and compress it. The compressed air from the compressor section enters one or more combustors in the combustor section. The compressed air is mixed with the fuel in the combustors, and the air-fuel mixture can be burned in the combustors to form a hot working gas. The hot working gas is routed to the turbine section where it is expanded through alternating rows of stationary airfoils and rotating airfoils and used to generate power that can drive a rotor. The expanded gas exiting the turbine section may then be exhausted from the engine via the exhaust section.

The exhaust section of a turbine engine typically includes an exhaust cylinder and an exhaust manifold. During engine operation, hot exhaust gases exiting the turbine section pass through the exhaust cylinder and the exhaust manifold, causing these components to thermally expand in the radial direction. However, the exhaust cylinder and the exhaust manifold may expand at different rates. In some engines, the interface between the exhaust cylinder and the exhaust manifold is rigid at least in the radial direction, thereby inhibiting relative radial movement of these components. Consequently, stresses are placed on the interface, making it susceptible to low cycle fatigue (LCF), which can manifest as cracks, fractures or failures.

SUMMARY OF THE INVENTION

In accordance with an aspect of the invention, a flange connection may be provided in a gas turbine engine for joining a turbine exhaust cylinder and a turbine exhaust manifold, the exhaust cylinder including a cylinder flange having an axial face extending radially and facing axially toward the exhaust manifold. The flange connection comprises a stub flange attached to the exhaust manifold and configured to extend in a radial direction outwardly from a centerline of the exhaust cylinder, and the stub flange has a first axial face for engagement with the axial face of the cylinder flange. A plate structure is configured to provide axial retention of the stub flange to the axial face of the cylinder flange, and the plate structure includes a beam portion extending radially inwardly and engaging a second axial face of the stub flange. An engagement of the axial face of the cylinder flange and the beam portion of the plate structure with the stub flange forms an interference fit to provide two degrees of freedom of the stub flange relative to the exhaust cylinder.

In accordance with additional aspects of the invention, one of the degrees of freedom provided by the engagement of the stub flange between the plate structure and the cylinder flange may comprise a rolling movement of the stub flange relative to the exhaust cylinder, and the rolling movement of the stub flange may be provided by the first axial face of the stub flange being defined as a curved surface having a radius about an axis orthogonal to the radial direction. Further, the second axial face of the stub flange may be defined as a curved surface having a radius about an axis orthogonal to the radial direction and the curvature of the first and second axial faces of the stub flange may extend axially outwardly in opposite directions. The plate structure may include an attachment portion located radially outwardly from the beam portion and having fastener openings for receiving fasteners to rigidly affix the plate structure relative to the exhaust cylinder. The stub flange may be movable with one or more degrees of freedom in a plane parallel to the axial face of the exhaust cylinder, including movement in the radial direction relative to the central axis of the exhaust cylinder, and the stub flange may be movable in a rolling movement of the stub flange about an axis orthogonal to the radial direction.

In accordance with further aspects of the invention, the stub flange may comprise a substantially continuous annular member extending around a periphery of the exhaust manifold. The substantially continuous annular member may include an outer peripheral surface and tab structures may extend radially outwardly from the outer peripheral surface. The flange connection may further include spacer segments extending between the axial face of the exhaust cylinder and the plate structure and configured for engagement with the tabs, and an engagement of each tab with one or more respective spacer segments may effect a centering of the stub flange relative to the centerline of the exhaust cylinder. At least two of the tabs may comprise vertical tabs located at upper center and lower center locations, and at least two of the tabs may comprise horizontal tabs located at opposing lateral locations vertically midway between the upper and lower locations on the stub flange.

In accordance with yet a further aspect of the invention, a flange connection may be provided in a gas turbine engine for joining first and second components, the first and second components formed by cylindrical structures defining a hot gas path through the gas turbine engine and the first component including a first flange having an axial face extending radially and facing axially toward the second component. The flange connection comprises a second flange attached to the second component and configured to extend in a radial direction outwardly from a centerline of the first component and having a first axial face for engagement with the axial face of the first flange. A plate structure is configured to provide axial retention of the second flange to the axial face of the first flange, the plate structure including a beam portion extending radially inwardly and engaging a second axial face of the second flange. The second flange is configured to engage between the beam portion and the axial face of the first flange for effecting a rolling movement of the second flange relative to the axial face of the first flange.

In accordance with additional aspects of the invention, the first axial face of the second flange may be defined as a curved surface having a radius about an axis of curvature orthogonal to the radial direction for effecting the rolling movement about an axis parallel to the axis of curvature, and the second axial face of the second flange may be defined as a curved surface having a radius about an axis orthogonal to the radial direction, and the curvature of the first and second surfaces of the second flange may extend axially outwardly in opposite directions. The second flange may comprise a substantially continuous annular member extending around a periphery of the second component and including an outer peripheral surface, and the plate structure may be rigidly affixed to the first component flange with the beam portion of the plate structure located in axially spaced relation to the axial face of the first flange at an attachment location radially outwardly from the outer peripheral surface of the second flange. The second flange may be held in position in an interference fit between the beam portion of the plate structure and the axial face of the first flange. The second flange may comprise a radial portion of a stub flange structure, and the radial portion may be formed continuously with an axial portion, the radial portion defining the first and second axial faces of the second flange and the axial portion forming an axial extension affixed to a periphery of the second component.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
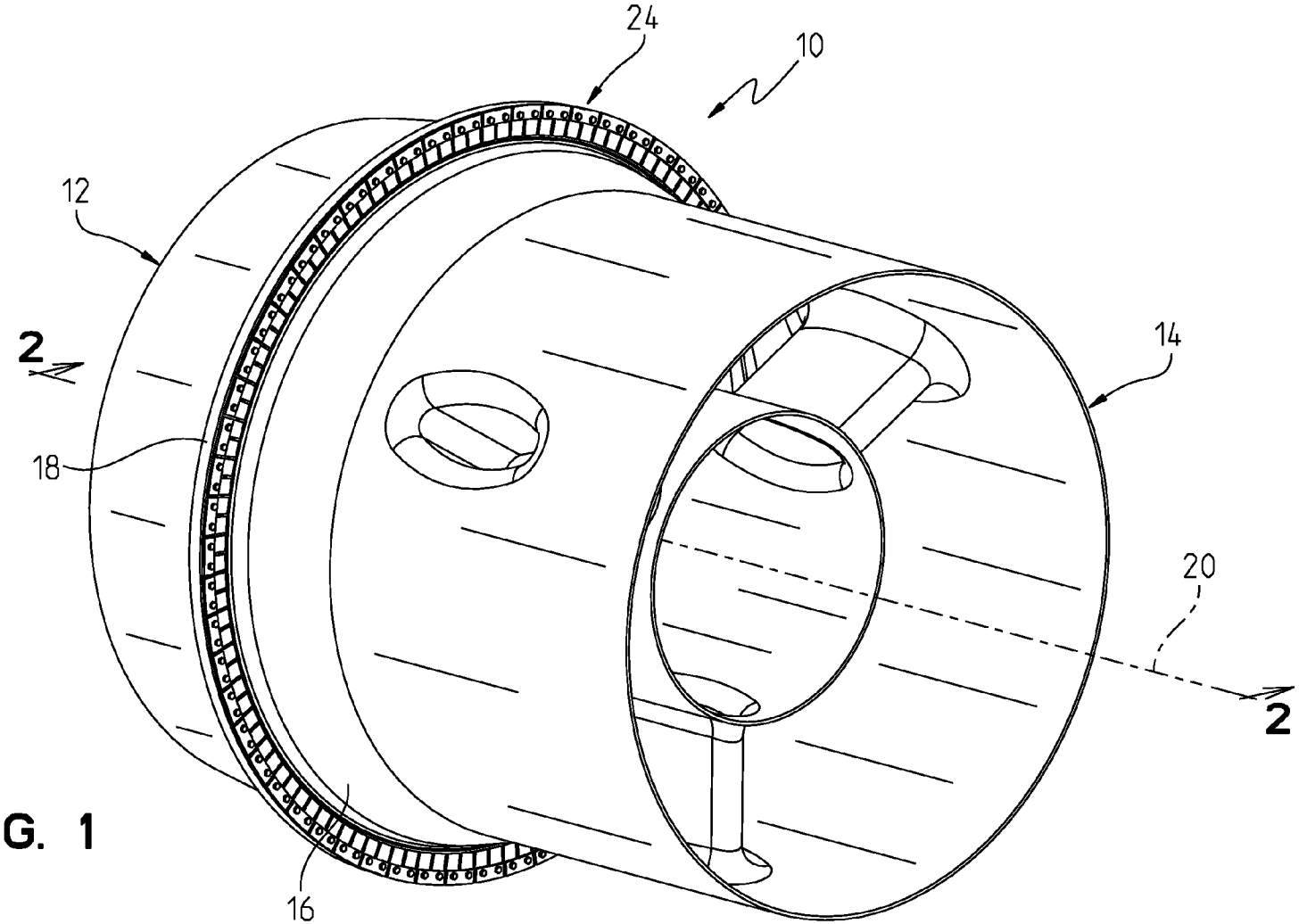
FIG. 1 is a perspective view of an exhaust section of a gas turbine engine including an exhaust cylinder and an exhaust manifold joined at a flange connection in accordance with the present invention.

Referring to FIG. 1, a portion of an exhaust section 10 of a gas turbine engine (not shown) is shown to illustrate aspects of the present invention. The exhaust section 10 includes an exhaust cylinder 12, and an exhaust manifold 14 having a cone 16 located at an upstream end thereof. The exhaust cylinder 12 generally comprises a cylindrical component forming a downstream extension of a casing for the gas turbine engine, and the exhaust manifold 14 generally comprises a cylindrical component Referring further to FIG. 2, the exhaust cylinder 12 includes a cylinder flange 18 that extends radially outwardly from a centerline 20 of the exhaust cylinder 12, and that is joined to a stub flange structure 22 at a flange connection 24. The stub flange structure 22 includes an axial portion 26 having a proximal end 28 and a distal end 30, the distal end 30 being rigidly affixed to an upstream end of the cone section 16 of the exhaust manifold 14, such as at a weld joint 31. A radial portion of the stub flange structure 22, defining a manifold or stub flange 32, includes a proximal end 34 and a distal end 36. The stub flange 32 is preferably circumferentially continuous and the proximal end 34 of the stub flange 32 is connected to the proximal end 28 of the axial portion 26 at a bend or continuous transition 38 of the stub flange structure 22. The stub flange 32 may be welded to the axial portion 26, or the stub flange 32 and axial portion may be formed of a single piece of material. The axial portion 26 may extend radially inwardly at an angle that substantially matches an angle of the cone section 16.

Figure 2:
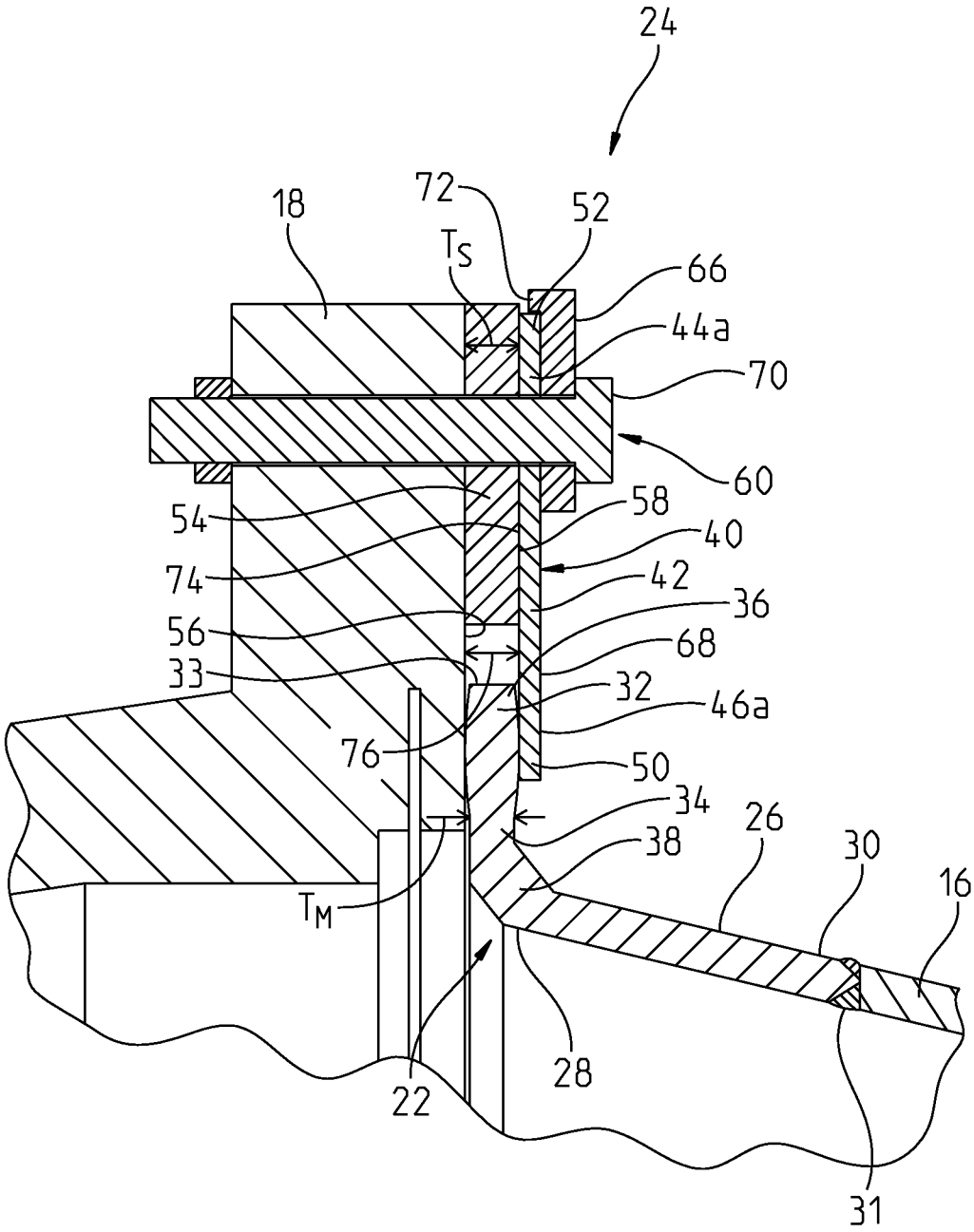
FIG. 2 is a cross-sectional view of the flange connection taken at a location corresponding to line 2-2 in FIG. 1.
Figure 5:
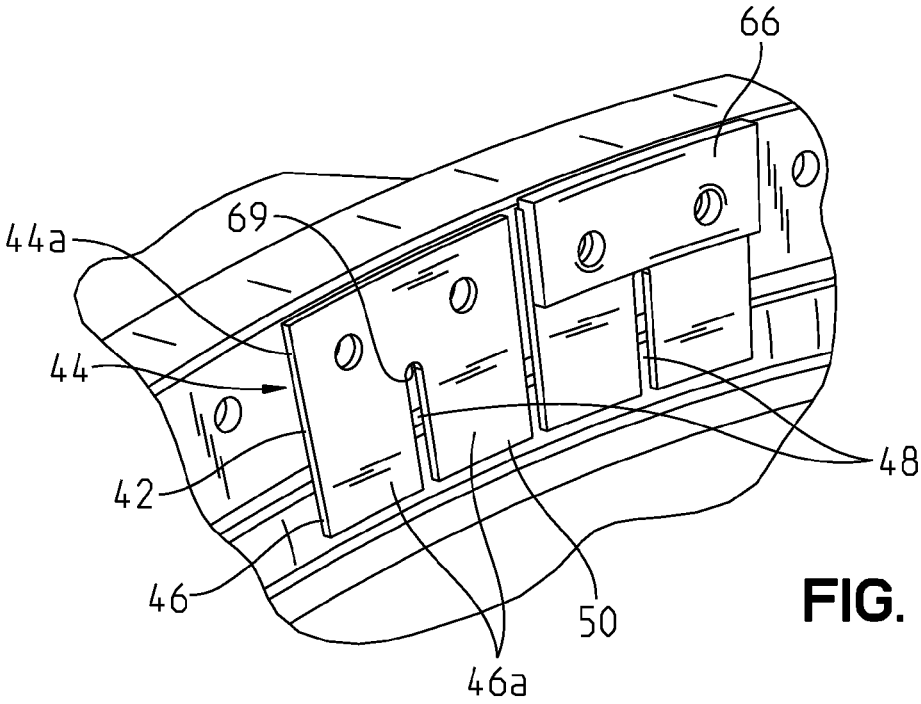
FIG. 5 is a perspective view of a portion of the flange connection, shown partially disassembled.

Referring to FIGS. 2 and 5, the flange connection 24 further includes a plate structure 40 comprising of a plurality of plates 42 continuously located in side-by-side relation around the circumference of the cylinder flange 18. Each plate 42 may include an attachment section 44*a*, and the plurality of attachment sections 44*a* define an attachment portion 44 of the plate structure 40. Each plate 42 may further include one or more plate springs 46*a* extending radially inwardly from a respective attachment section 44*a* and defining a resilient beam portion 46 of the plate structure 40. In the illustrated embodiment, each plate 42 includes a pair of plate springs 46*a*. The plate springs 46*a* of each plate 42 may be separated by a predetermined spacing or gap 48 which extends from an inner end 50 of the plate 42 radially outwardly to a location that is generally greater than half the distance toward an outer end 52 of the plate 42.

The plates 42 may be formed as relatively thin members, i.e., relative to the thickness TM of the stub flange 32, and are preferably formed of a high temperature spring material, such as a spring material formed of a nickel-based alloy, for example, INCONEL®. The plurality of plate springs 46*a* enable the beam portion 46 to apply a substantially uniform predetermined resilient or spring force against the stub flange 32 around the circumference of the stub flange 32 at a plurality of discrete locations, as defined by each of the plate springs 46*a*. In particular, each plate spring 46*a* may resiliently flex and apply a force against the stub flange 32 independently of the other plate springs 46*a* to bias the stub flange 32 in sealing engagement against the cylinder flange 18 to permit movement of the stub flange 32 relative to the cylinder flange 18, as will be described further below.

Figure 3:
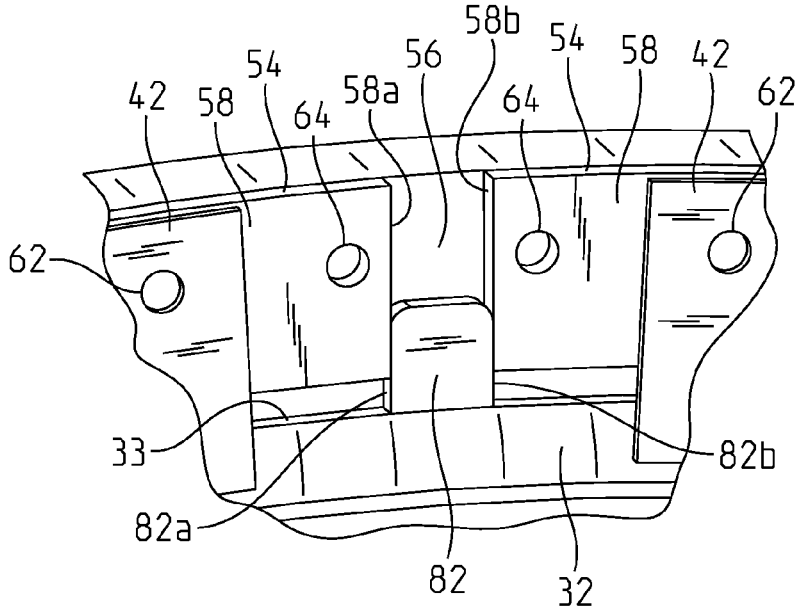
FIG. 3 is an elevational axial view of a portion of the flange connection, shown partially disassembled, at an upper circumferential location on a cylinder flange of the exhaust section.
Figure 4:
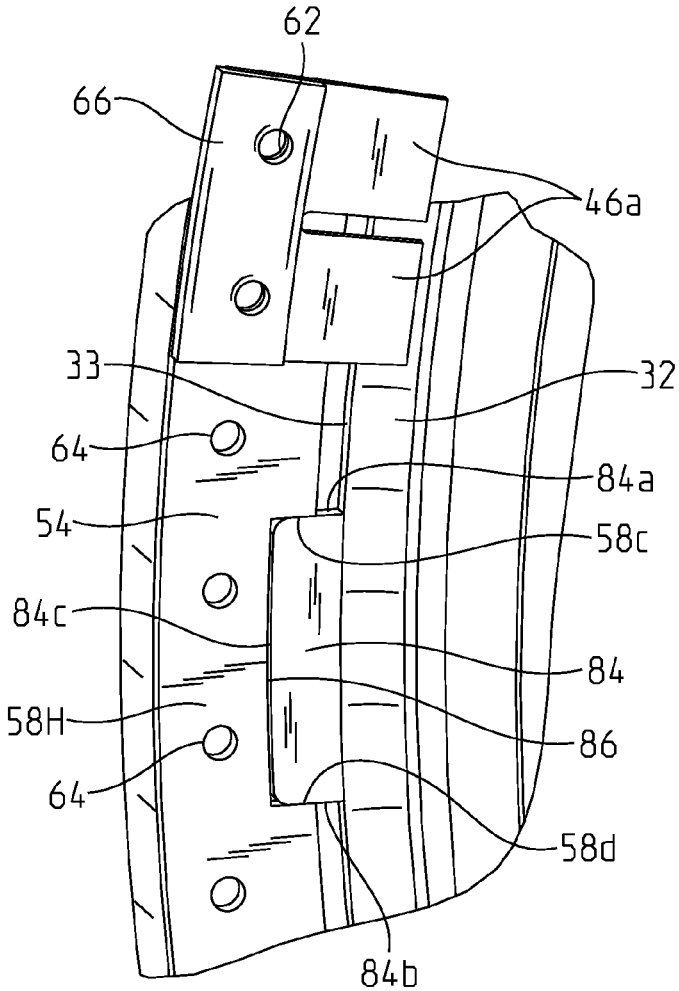
FIG. 4 is an elevational axial view of a portion of the flange connection, shown partially disassembled, at a lateral circumferential location on the cylinder flange of the exhaust section.

Referring to FIGS. 2-4, a plurality of spacer/stabilizer segments 54 may be provided positioned around the cylinder flange 18, radially aligned with the attachment portion 44 of the plate structure 40, and extending radially inwardly to a location adjacent to an outer peripheral surface 33 of the stub flange 32. The spacer/stabilizer segments 54 are positioned in engagement with an axial face 56 of the cylinder flange 18, and one or more of the plates 42 are positioned against an axially downstream facing side 58 of each spacer/stabilizer segment 54. Fasteners, such as bolts 60, may extend through fastener openings 62 in the attachment plates 42, and pass through fastener openings 64 in the spacer/stabilizers segments 54 and through the cylinder flange 18 to rigidly affix the plates 42 relative to the exhaust cylinder 12.

In addition, a retainer 66 may be positioned in engagement with a downstream face 68 of each plate 42, extending radially inwardly such that a radial inner edge 69 of the retainer 66 is generally adjacent to an outer end of a respective gap 48 (FIG. 5). Each retainer 66 extends across the width of a respective plate 42 to distribute the load of the fasteners 60, such as is applied by the head 70 of a bolt (FIG. 2), across the face 68 of the plate 42. The retainer 66 may also include a shoulder portion 72 extending across the outer end 52 of the plate 42 to counteract rotation forces on the plates 42 relative to centerlines of the fasteners 60.

As seen in FIG. 2, the spacer/stabilizer segments 54 are formed with a predetermined thickness $T_S$, selected to provide a predetermined distance 76 between an upstream face 74 of each plate 42 and the axial face 56 of the cylinder flange 18. The spacing 76 between the upstream face 74 of each plate 42 and the axial face 56 of the cylinder flange 18 is selected to provide an interference fit of the stub flange 32 between the plate structure 40 and the cylinder flange 18, with a predetermined preload exerted by the plate springs 46*a* against the stub flange 32. In particular, the spacing 76, determined by the thickness $T_S$ of the spacer/stabilizer segments 54, and the spring constant of the plate springs 46*a* determine the force applied against the stub flange 32. The interference fit of the stub flange 32 between the plate structure 40 and the cylinder flange 18 provides at least one degree of freedom of the stub flange 32 in a plane parallel to the cylinder flange 18, including a degree of freedom in the radial direction relative to the centerline 20 of the exhaust cylinder 12, i.e., a radial direction as determined with reference to a cylindrical coordinate system and extending perpendicular to the centerline 20 of the exhaust cylinder 12. In addition, the stub flange 32 may have a degree of freedom in the lateral direction, i.e., a lateral direction generally transverse to the radial direction, permitting circumferential expansion of the stub flange 32 relative the cylinder flange 18. Hence, the interference fit of the stub flange 32 between the plate structure 40 and the cylinder flange 18 is configured to permit radial and circumferential growth of the stub flange 32, such as may occur during thermal transitions resulting in a thermal expansion and/or contraction of the stub flange 32 during operation of the engine.

It should be understood that the spacing between the plate springs 46*a* and/or between the plates 42 may be varied from that shown to obtain a desired overall pressure applied against the stub flange 32. For example, a spacing between the plate springs 46*a* and/or the plates 42 may be greater than that shown herein while still providing sufficient pressure to seal the stub flange 32 against the cylinder flange 18.

Figure 6:
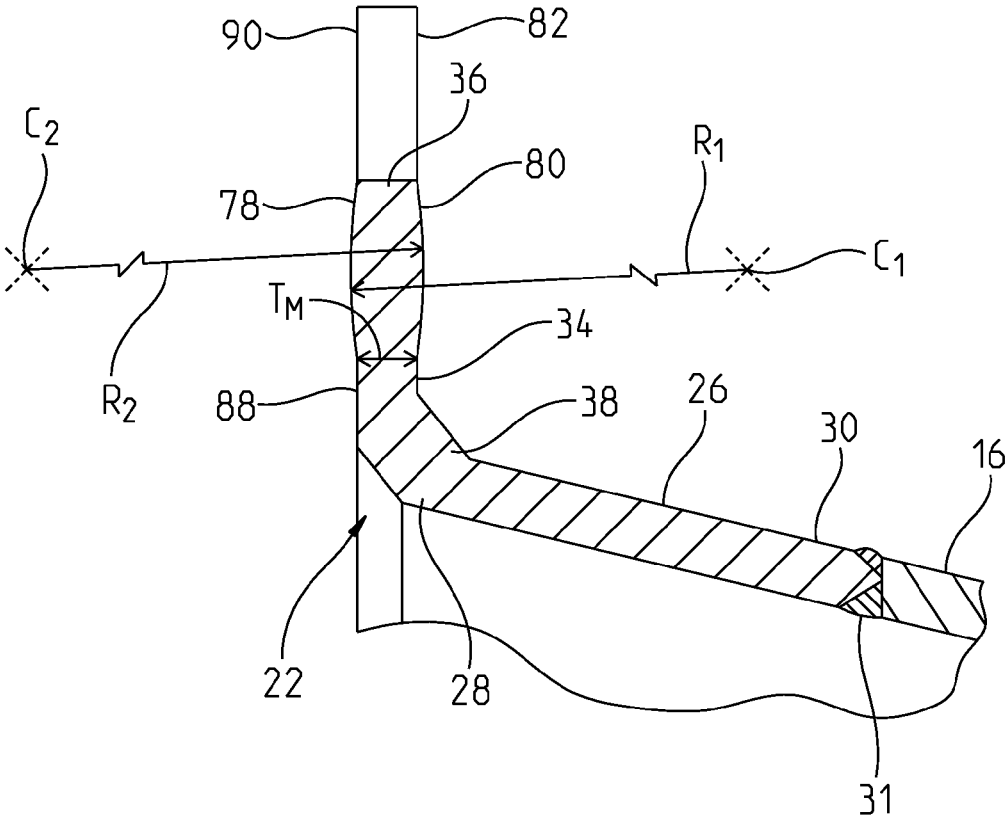
FIG. 6 is a cross-sectional view of a stub flange structure for the flange connection.

Referring to FIG. 6, the stub flange 32 of the stub flange structure 22 includes a first axial face 78 that engages with the axial face 56 of the cylinder flange 18, and a second axial face 80 that engages with the upstream face 74 of a respective plate 42. The first and second axial faces 78, 80 are defined as continuous curved surfaces, extending in the radial direction between the proximal and distal ends 34, 36. Each of the first and second axial faces 78, 80 of the stub flange 32 have a radius with a curvature about an axis orthogonal to the radial direction. As can be seen in FIG. 6, the first and second axial faces 78, 80 extend radially outwardly in opposite directions. The first axial surface 78 may have a first radius of curvature $R_1$ extending from a first center of curvature $C_1$, and the second axial surface 80 may have a second radius of curvature $R_2$ extending from a second center of curvature $C_2$. The first and second centers of curvature $C_1$, $C_2$ may define locations of the orthogonal axes, corresponding to particular circumferential locations on the stub flange 32, which axes extend parallel to the axial face 56 of the cylinder flange 18 and extend orthogonal to a radius of the cylindrical coordinate system centered on the centerline 20 (FIG. 1). The first and second radii of curvature $R_1$, $R_2$ provide a line or narrow band of contact between the first and second axial surfaces 78, 80 and the cylinder flange 18 and the beam portion 46, respectively, wherein the band of contact comprises a narrow elongated contact area extending in the lateral or circumferential direction of the cylinder flange 18.

The first radius of curvature $R_1$ is preferably selected with reference to a predetermined contact pressure between the first axial face 78 of the stub flange 32 and the axial face 56 of the cylinder flange 18, and with reference to the amount of wear that may occur at the contact between the stub flange 32 and the cylinder flange 18. In particular, a lower first radius of curvature $R_1$, i.e., providing a narrower band of contact between the stub flange 32 and the cylinder flange 18, can provide a higher contact pressure to increase the pressure applied for sealing between the stub flange 32 and the cylinder flange 18. On the other hand, an increased pressure and reduced area of contact between the stub flange 32 and the cylinder flange 18 may increase the wear at the contact between these components. Hence, the first radius of curvature $R_1$ is preferably selected to provide a balance between the desired sealing contact pressure and the acceptable wear that may occur at the contact between the stub flange 32 and the cylinder flange 18.

The second radius of curvature $R_2$ is preferably selected to ensure that a substantially uniform biasing force is applied by the beam portion 46 during rolling movement of the stub flange 32. The second radius of curvature $R_2$ may be the same as the first radius of curvature $R_1$, or the first and second radii of curvature $R_1$, $R_2$ may be different from each other.

The contact of the curved axial surfaces 78, 80 with the cylinder flange 18 and the beam portion 46 provides an additional degree of freedom for the stub flange 32, i.e., a degree of freedom in addition to the degree(s) of freedom permitting movement of the stub flange 32 in the plane parallel to the axial face 56 of the cylinder flange 18. The additional degree of freedom of the stub flange 32 is in the form of rolling movement of the stub flange 32 relative to the cylinder flange 18 and the beam portion 46. During operation of the engine, axial movement of the stub support structure 22, such as may be produced by axial forces applied to the axial portion 26 from the exhaust manifold 14, may cause the stub flange 32 to pivot or roll relative to the cylinder flange. The rolling movement of the stub flange 32 may reduce or minimize a prying load applied to the stub flange 32 and increase the low cycle life (LCF) of the stub flange 32. The rolling movement of the stub flange 32 may also reduce or minimize stresses at other locations of the stub flange structure 22, such as at the joint 31 between the stub flange structure 22 and the cone 16 of the exhaust manifold 14. Further, the engagement of the curved first axial surface 78 with the cylinder flange 18 provides a continuous engagement at a predetermined pressure of the stub flange 32 with the cylinder flange 18, and ensures that a consistent contact and substantially uniform pressure are applied between the stub flange 32 and the cylinder flange 18, thereby eliminating the need for a separate seal element between these two structures.

Referring to FIGS. 3 and 4, the spacer/stabilizer segments 54 at the top, bottom and opposing lateral sides of the cylinder flange 18 may provide a stabilizing support for maintaining the stub flange structure 22 within a predetermined location relative to the centerline 20 of the exhaust cylinder 12. In particular, as seen in FIG. 3, an upper vertical tab 82 extends radially outwardly from the outer peripheral surface 33 of the stub flange 32 at the distal end 36 (see also FIG. 6). The vertical tab 82 may be integral with the stub flange 32 at a top center location, i.e., at a top dead center location (TDC), and includes opposing vertical edges 82*a* and 82*b* which are engaged by respective vertical edges 58*a* and 58*b* of adjacent spacer/stabilizer segments 58. It should be noted that the adjacent spacer/stabilizer segments 58 are positioned in spaced relation to each other at this location at a spacing or distance substantially equal to the width of the vertical tab 82 between the vertical edges 82*a*, 82*b*. A similar lower vertical tab (not shown) may be provided extending radially outwardly at a lower center location of the stub flange 32, i.e., at a bottom dead center location (BDC), and may be engaged with adjacent spacer/stabilizer segments 58 in the same configuration as is illustrated for the tab 82 in FIG. 3.

As seen in FIG. 4, a first horizontal tab 84 extends radially outwardly from the outer peripheral surface 33 of the stub flange 32 in the same manner as described above for the vertical tab 82. The horizontal tab 84 may be integral with the stub flange 32 at a lateral location between the top and bottom of the stub flange 32, and includes opposing horizontal edges 84*a* and 84*b* which are engaged by respective horizontal edges 58*c* and 58*d* formed in an elongated spacer/stabilizer segment 58H. That is, the elongated spacer/stabilizer segment 58H may be formed with a slot 86 that is configured to receive the horizontal tab 84. It should be noted that the opposing horizontal edges 84*a* and 84*b* of the horizontal tab 84 are spaced apart a distance that is substantially equal to the spacing between the horizontal edges 58*c* and 58*d* formed in an elongated spacer/stabilizer segment 58H. A similar second horizontal tab (not shown) may be provided extending radially outwardly the opposite lateral location on the stub flange 32, and may be engaged with an elongated spacer/stabilizer segment having the same configuration as is illustrated for the spacer/stabilizer segment 58H engaged with the tab 84 in FIG. 4.

With regard to the vertical and horizontal tabs 82, 84 illustrated in FIGS. 3 and 4, it should be noted that one or more plates 42 are removed in these views to illustrate the location and engagement of the tabs 82, 84 with the respective spacer/stabilizer segments 58, 58H. In addition, it should be noted that an upstream side of each of the tabs 82, 84, as illustrated by the upstream side 86 of the tab 82 in FIG. 6, is preferably substantially aligned with the upstream side 88 of the stub flange 32, i.e., at a surface adjacent to the curved surface 78. Hence, the upstream sides of the tabs 82, 84 may positioned slightly spaced from the axial face 56 of the cylinder flange 18 to permit rolling movement of the stub flange 32.

The engagement of the vertical tabs 82 with respective adjacent spacer/stabilizer segments 58 and engagement of the horizontal tabs 84 with the respective spacer/stabilizer segments 58H operate to prevent tangential movement of the stub flange 32, as determined with reference to the cylindrical coordinate system, relative to the centerline 20. Further, in the event of a failure of a support, such as a support strap (not shown), for vertically supporting the exhaust manifold 14, the horizontal spacer/stabilizer segments 58H may operate to support the stub flange structure 22 at the horizontal tabs 84 to thereby maintain the exhaust manifold 14 vertically aligned with the exhaust cylinder 12.

The above-described flange connection provides a cantilevered stub flange 32 that permits the stub flange 32 to accommodate differential deflection relative to the cylinder flange 18 during thermal transients to minimize or reduce stresses that may otherwise occur, such as may otherwise occur with rigidly affixed flange structures. The flange connection maintains the stub flange 32 in a predetermined centered position relative to the cylinder flange 18 while permitting expansion radially and in a lateral or circumferential direction of the stub flange 32, as well as permitting rolling movement to avoid a prying load, i.e., beam flexure of the stub flange 32, while maintaining the sealed condition of the stub flange 32 to the cylinder flange 18.

It should be understood that although the aspects of the structure described herein are described with reference to an exhaust cylinder and exhaust manifold, the present invention may be applicable to other cylindrical engine structures that may be joined together and that have different thermal expansion characteristics.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. In a gas turbine engine, a flange connection for joining a turbine exhaust cylinder and a turbine exhaust manifold, the exhaust cylinder including a cylinder flange having an axial face extending radially and facing axially toward the exhaust manifold, the flange connection comprising:

a stub flange attached to the exhaust manifold and configured to extend in a radial direction outwardly from a centerline of the exhaust cylinder, the stub flange having a first axial face for engagement with the axial face of the cylinder flange;

a plate structure configured to provide axial retention of the stub flange to the axial face of the cylinder flange, the plate structure including a beam portion extending radially inwardly and engaging a second axial face of the stub flange;

an engagement of the axial face of the cylinder flange and the beam portion of the plate structure with the stub flange forming an interference fit to provide two degrees of freedom of the stub flange relative to the exhaust cylinder; and wherein one of the degrees of freedom provided by the engagement of the stub flange between the plate structure and the cylinder flange comprises a rolling movement of the stub flange relative to the exhaust cylinder provided by the first axial face of the stub flange being defined as a curved surface having a radius about an axis orthogonal to the radial direction.

2. The flange connection of claim 1, wherein the second axial face of the stub flange is defined as a curved surface having a radius about an axis orthogonal to the radial direction and the curvature of the first and second axial faces of the stub flange extend axially outwardly in opposite directions.

3. The flange connection of claim 1, wherein the plate structure includes an attachment portion located radially outwardly from the beam portion and having fastener openings for receiving fasteners to rigidly affix the plate structure relative to the exhaust cylinder.

4. The flange connection of claim 1, wherein the stub flange is movable with one or more degrees of freedom in a plane parallel to the axial face of the exhaust cylinder, including movement in the radial direction relative to the central axis of the exhaust cylinder, and the stub flange is movable in a rolling movement of the stub flange about an axis orthogonal to the radial direction.

5. The flange connection of claim 1, wherein the stub flange comprises a substantially continuous annular member extending around a periphery of the exhaust manifold.

6. In a gas turbine engine, a flange connection for joining a turbine exhaust cylinder and a turbine exhaust manifold, the exhaust cylinder including a cylinder flange having an axial face extending radially and facing axially toward the exhaust manifold, the flange connection comprising:

a stub flange comprising a substantially continuous annular member extending around a periphery of the exhaust manifold and configured to extend in a radial direction outwardly from a centerline of the exhaust cylinder, the stub flange having a first axial face for engagement with the axial face of the cylinder flange;

a plate structure configured to provide axial retention of the stub flange to the axial face of the cylinder flange, the plate structure including a beam portion extending radially inwardly and engaging a second axial face of the stub flange; and an engagement of the axial face of the cylinder flange and the beam portion of the plate structure with the stub flange forming an interference fit to provide two degrees of freedom of the stub flange relative to the exhaust cylinder; and wherein the substantially continuous annular member includes an outer peripheral surface and tab structures extending radially outwardly from the outer peripheral surface, and further including spacer segments extending between the axial face of the exhaust cylinder and the plate structure and configured for engagement with the tabs.

7. The flange connection of claim 6, wherein an engagement of each tab with one or more respective spacer segments effects a centering of the stub flange relative to the centerline of the exhaust cylinder.

8. The flange connection of claim 7, wherein at least two of the tabs comprise vertical tabs located at upper center and lower center locations, and at least two of the tabs comprise horizontal tabs located at opposing lateral locations vertically midway between the upper and lower locations on the stub flange.

9. In a gas turbine engine, a flange connection for joining first and second components, the first and second components formed by cylindrical structures defining a hot gas path through the gas turbine engine and the first component including a first flange having an axial face extending radially and facing axially toward the second component, the flange connection comprising:

a second flange attached to the second component, the second flange being formed as a circumferentially continuous annular flange and configured to extend in a radial direction outwardly from a centerline of the first component and having a first axial face for engagement with the axial face of the first flange;

a plate structure configured to provide axial retention of the second flange to the axial face of the first flange, the plate structure including a beam portion extending radially inwardly and engaging a second axial face of the second flange; and the plate structure having a thinner thickness and greater flexibility than the second flange, and the second flange configured to engage between the beam portion and the axial face of the first flange for effecting a rolling movement of the second flange relative to the axial face of the first flange, and the plate structure flexing in response to the rolling movement.

10. The flange connection of claim 9, wherein the first axial face of the second flange is defined as a curved surface having a radius about an axis of curvature orthogonal to the radial direction for effecting the rolling movement about an axis parallel to the axis of curvature.

11. The flange connection of claim 10, wherein the second axial face of the second flange is defined as a curved surface having a radius about an axis orthogonal to the radial direction, and the curvature of the first and second surfaces of the second flange extend axially outwardly in opposite directions.

12. The flange connection of claim 9, wherein the second flange comprises an outer peripheral surface.

13. The flange connection of claim 12, wherein the plate structure is rigidly affixed to the first component flange with the beam portion of the plate structure located in axially spaced relation to the axial face of the first flange at an attachment location radially outwardly from the outer peripheral surface of the second flange.

14. The flange connection of claim 13, wherein the second flange is held in position in an interference fit between the beam portion of the plate structure and the axial face of the first flange.

15. The flange connection of claim 9, wherein the second flange comprises a radial portion of a stub flange structure, and the radial portion is formed continuously with an axial portion, the radial portion defining the first and second axial faces of the second flange and the axial portion forming an axial extension affixed to a periphery of the second component.

16. The flange connection of claim 9, wherein the plate structure includes an attachment portion located radially outward from the beam portion and having fastener openings for receiving fasteners to rigidly affix the plate structure to the axial face of the first flange.

17. The flange connection of claim 16, wherein the plate structure includes a pair of plate springs forming the beam portion, the plate springs separated by a slot extending from a radially inner end of the plate structure to the attachment portion such that the plate springs are movable independently of each other.

* * * * *